United States Patent [19]

Williams

[11] 4,112,043

[45] Sep. 5, 1978

[54] ELECTRICAL CONDUCTOR FOR A BUSHING AND METHOD OF MAKING AN ELECTRICAL BUSHING

[75] Inventor: Charles F. Williams, Edinboro, Pa.

[73] Assignee: Teledyne Penn-Union, Edinboro, Pa.

[21] Appl. No.: 734,451

[22] Filed: Oct. 21, 1976

[51] Int. Cl.[2] ..... H01B 19/00; H01B 5/02; H01B 17/26; B22D 19/00

[52] U.S. Cl. ..... 264/250; 164/98; 174/126 CP; 174/152 R; 264/272; 264/276

[58] Field of Search ..... 174/126 CP, 152 R, 153 R; 339/218 R, 218 M, 275 B, 278 R, 278 T; 164/98; 264/272, 276, 250; 425/129 R, DIG. 47

[56] References Cited

U.S. PATENT DOCUMENTS

| | | | |
|---|---|---|---|
| 2,674,841 | 4/1954 | Shafer | 264/276 X |
| 2,724,864 | 11/1955 | Krotz | 264/276 |
| 3,387,076 | 6/1968 | Murooka | 264/276 |
| 3,433,893 | 3/1969 | Hofmann et al. | 174/153 R |

FOREIGN PATENT DOCUMENTS

| | | | |
|---|---|---|---|
| 1,383,979 | 11/1964 | France | 174/152 R |
| 46-17,268 | 5/1971 | Japan | 174/152 R |

*Primary Examiner*—Laramie E. Askin
*Attorney, Agent, or Firm*—Olson, Trexler, Wolters, Bushnell & Fosse, Ltd.

[57] ABSTRACT

A bushing assembly adapted for installation as a feed-through type of connection in a transformer, switchgear, sectionalizing point or any other application includes a cast conductor element embedded in a body of molded insulating material, and an insert preformed to close tolerances in said cast element and adapted to cooperate with a section of an insulating material mold to seal the mold during molding of the body of insulating material.

3 Claims, 6 Drawing Figures

10
12
14

30
38
40
32
42
18
44
28
58
66
36
26
34

12
28
24
18
16
22
24

4
56
20
58
16
28
26
22
4
24

56
26
22
64

64
56
54
48
58
66
46
50
54
52
60
62

ELECTRICAL CONDUCTOR FOR A BUSHING AND METHOD OF MAKING AN ELECTRICAL BUSHING

BACKGROUND OF THE INVENTION

The present invention relates to a novel electrical bushing assembly and method of making the same, and more specifically to a novel assembly comprising a metal connector or terminal element enclosed by a body or sheath of insulating material molded thereon.

It will be appreciated that bushing assemblies of the type contemplated herein may be used in a wide variety of electrical installations where it is desired to provide an insulated connection through a support or a wall of a housing or enclosure. Examples of such installations include transformers, switchgear and the like.

Heretofore, electrical bushing assemblies of the general type contemplated herein have been produced by first casting the metal electrical element or terminal member and then placing such member in a mold and pressure molding insulating material therearound. In order to leave the conductor element or terminal member with exposed ends, the element is formed so that such ends project from the mold cavity. At areas where the electrical element projects from the mold cavity, it is desired that a very close and tight fit be obtained between the mold and the element so that the element acts as a shutoff and insulating material will not leak out of the cavity during a molding operation.

It will be appreciated that electrical conductor or terminal elements of the type contemplated herein are usually cast in sand molds. Such a process usually does not produce the close tolerances required to enable the element to have the desired tight fit with the mold body. Heretofore, it has been the general pracitice to process such cast terminal elements by machining the desired area to obtain the necessary tolerances. In certain instances, it is difficult to obtain the desired tolerances even with such additional machining of the terminal element particularly when a relatively soft metal such as certain aluminum alloys is used in casting the element or terminal member.

SUMMARY OF THE INVENTION

It is an important object of the present invention to provide a novel electrical bushing of the above-described type which may be produced more economically.

A more specific object of the present invention is to provide a novel electrical bushing of the above-described type and a method of making the same whereby desired close tolerances are obtained at a desired specified area of the electrical conductor or terminal member in a reliable and economical manner for insuring the desired tight fit and shutoff function when assembled in a pressure type mold which is used to form a body of insulating material around the conductor member.

A still further specific object of the present invention is to provide a novel electrical conductor or terminal member for a bushing assembly of the above-described type and method of making the same wherein an economically produced insert preformed to the desired close tolerances is placed in the mold used to cast the electrical conductor member and is thereby embedded or incorporated in the cast member so that the member may be subsequently assembled with a pressure type mold without further machining or processing for obtaining the desired tolerances.

Other objects and advantages of the present invention will become apparent from the following description and the accompanying drawings.

DETAILED DESCRIPTION

Figure 1:
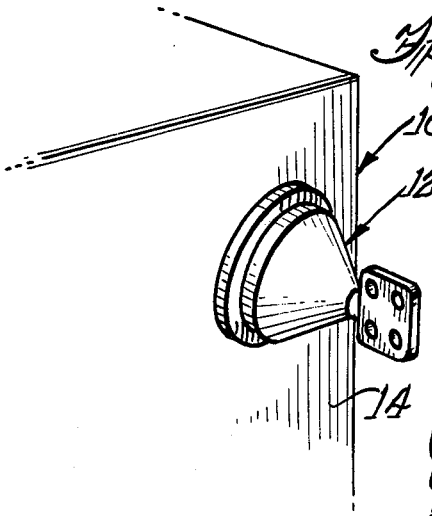
FIG. 1 is a fragmentary simplified perspective view showing an installation which may, for example, be a transformer including a bushing assembly incorporating features of the present invention.

Referring now more specifically to the drawings wherein like parts are designated by the same numerals throughout the various figures, an electrical installation is shown in FIG. 1 which includes a housing 10 and a bushing assembly 12 incorporating features of the present invention. It will be appreciated that the unit 10 may comprise a transformer, switchgear or any other desired structure presenting a wall or support member 14 through which it is desired to make an electrical connection with the aid of the bushing assembly 12.

Figure 2:
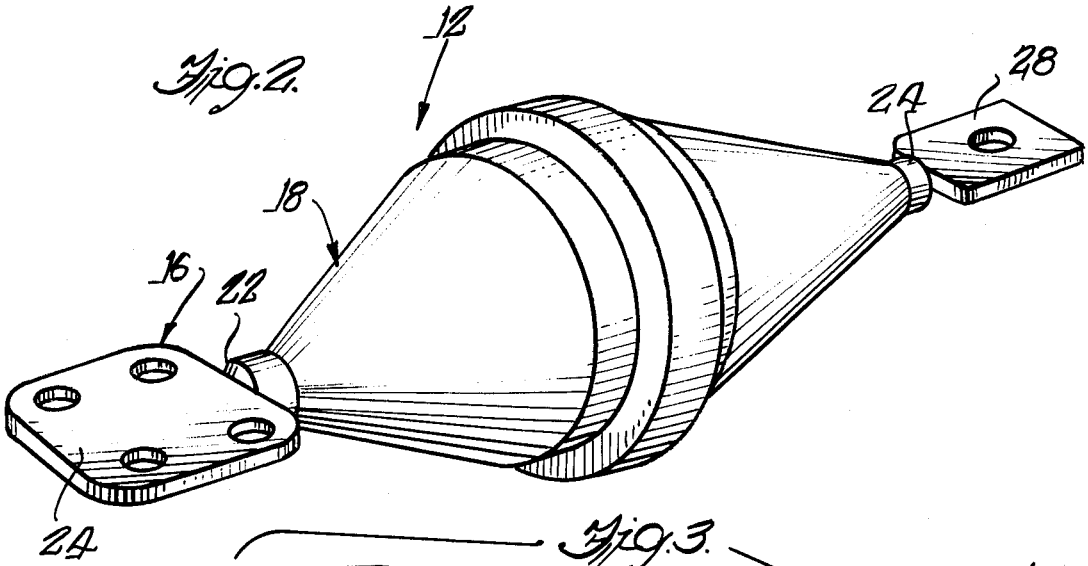
FIG. 2 is an enlarged perspective view showing a bushing assembly incorporating features of the present invention.

The bushing assembly 12 comprises an electrical conductor or terminal member 16 described in detail below and a body or sheath 18 of insulating material molded around the element 16 shown in FIG. 2. The insulating body may be formed from any suitable moldable insulating material such as plastic or rubber and may be provided with any desired exterior configuration adapted to interfit with the support member or apertured wall 14. It will be noted that while the insulating body 18 covers an intermediate portion of the electrical conductor member, one or both opposite end portions of the conductor remain exposed so as to permit connection to complementary electrical elements, not shown.

Figure 3:
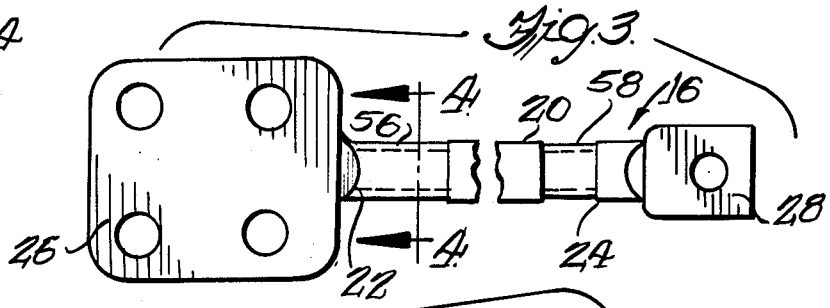
FIG. 3 is an elevational view showing an electrical conductor element or terminal member constructed in accordance with features of the present invention.
Figure 4:
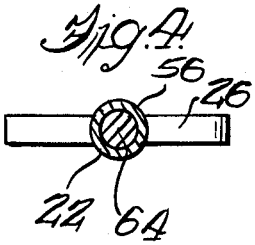
FIG. 4 is a sectional view taken along line 4—4 in FIG. 3.
Figure 5:
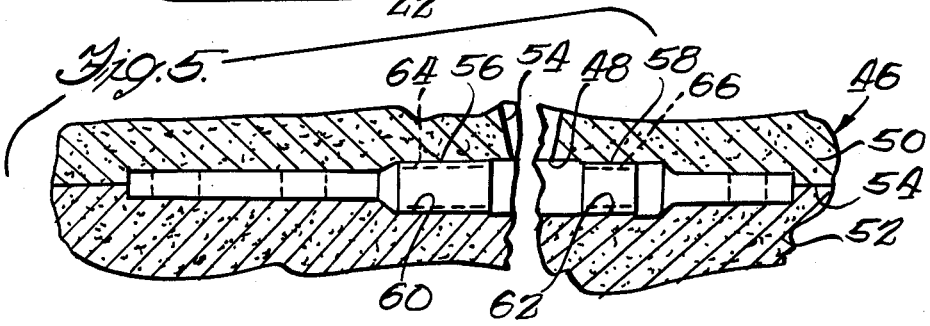
FIG. 5 is a sectional view showing a step in a process in accordance with the present invention wherein a terminal element of FIGS. 3 and 4 is cast.

As shown best in FIGS. 3–5, the electrical conductor member or terminal element 16 has an elongated intermediate portion 20, which is the portion to be covered by the insulating body 18. Neck portions 22 and 24 extend from opposite ends of the intermediate portion and respectively join terminal end portions 26 and 28. In the embodiment shown, the terminal end portions are flattened and are provided with one or more apertures for accommodating fasteners used to secure the terminal end portions to adjacent electrical elements, not shown. However, it will be understood that the terminal end portions of the member 16 may have any desired configuration suitable for joining to an electrical connector or conductor.

Figure 6:
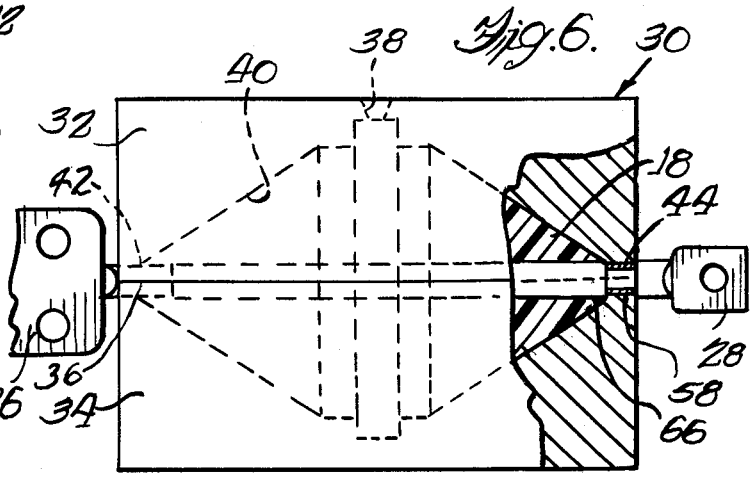
FIG. 6 is an elevational view partially broken away showing a further step in a process incorporating features of the present invention wherein the terminal element of FIGS. 3–5 is assembled in a mold and a body or sheath of plastic or other suitable electrical insulating material is molded around the terminal element.

As shown in FIG. 6, the insulating body or sheath 18 is formed around the terminal element or conductor 16 in a permanent mold 30 including upper and lower mold sections 32 and 34 which meet at a junction line 36. The mold 30 is adapted to be assembled in a pressure molding machine of known construction, not shown, so that suitable insulating material such as plastic or rubber may be forced into the mold under pressure through a suitable inlet 38, or distributed by pressure as in compression molding.

The complementary mold sections 32 and 34 are formed to present a mold cavity 40 of the desired configuration. As shown in FIG. 6, the conductor element or terminal member 16 is longer than the mold and the mold sections are provided with complementary cylindrical surfaces 42 and 44 providing passageways or outlets at opposite ends of the cavity adapted to accommodate the previously mentioned neck portions of the terminal member. The cylindrical mold surfaces 42 and 44 are formed to close tolerances and the neck portions 22 and 24 of the terminal member are also formed to close tolerances in accordance with features of the present invention so that a tight fit is obtained between the neck portions and the cylindrical surfaces 42 and 44 whereby the neck portions provide an effective shutoff preventing insulating material from leaking out of the mold cavity during a molding operation.

The terminal element 16 is produced by a casting operation. As shown in FIG. 5, a suitable mold 46 is provided for obtaining a mold cavity 48 having the desired configuration. Preferably, the mold is a sand mold including upper and lower sections 50 and 52 which mate at a parting line 54. Molten metal such as aluminum is poured into the mold through an opening 54 in a conventional manner.

In accordance with an important feature of the present invention, the aforementioned neck portions 22 and 24 of the conductor member or terminal element 16 are provided with external dimensions formed to close tolerances in a reliable and economical manner. More specifically, tubular inserts 56 and 58 are preformed by an extrusion or other process which enables their external and internal diameters to be controlled with much greater precision than the remainder of the terminal element 16 formed by the sand mold casting process. Preferably, stock material for the inserts 56 and 58 is made as an elongated extruded tubular rod which may have its exterior surface machined or otherwise finished if necessary. The inserts 56 and 58 are then cut as sections from the tubular stock material.

In accordance with the process of the present invention, the tubular inserts 56 and 58, after being severed from the stock material, are placed in seats 60 and 62 provided in the lower half 52 of the mold 46. Then the upper half of the mold is placed in position and molten metal is poured through the opening 54 in the usual manner. As the metal fills the cavity, it flows through and fills the tubular inserts 56 and 58 so as to provide core elements 64 and 66 connecting the terminal ends 26 and 28 with the intermediate portion 20 of the member 16. Thus, each of the neck portions 22 and 24 of the member 16 comprises an insert having an exterior surface formed to relatively close tolerances and a core element. The material of the insert is similar to the material of the remainder of the member so as to promote bonding therebetween. However, the insert material is preferably alloyed so as to have a melting point at least slightly higher than the melting point of the metal being cast to form the remainder of the member 16 so as to prevent damage to the inserts during the casting operation. The materials are selected with their coefficients of thermal expansion sufficiently close to each other so that the parts remain bonded together after cooling.

After the member 16 is cast with the inserts 56 and 58 in place, no further machining or processing of the part is necessary, except for cleaning. After cleaning in accordance with known procedures, the member 16 is inserted into the mold 30 so that the surfaces of the inserts 56 and 58 mate with the tubular surfaces 42 and 44 effectively to seal the mold cavity whereupon the pressure molding operation for the insulating body is carried out in accordance with known practices.

While a preferred embodiment of the present invention has been shown and described herein, it is obvious that many details may be changed without departing from the spirit and scope of the appended claims.

The invention is claimed as follows:

1. An electrical conductor element for a bushing assembly of the type described comprising an elongated cast metal conductor member including an intermediate portion around which a body of insulating material is to be molded, opposite free end portions for connection to complementary electrical elements and portions joining said intermediate portion and said opposite free end portions, and preformed tubular metal inserts surrounding and secured to said joining portions and having accurately dimensioned exterior surfaces cooperable with a mold during molding of a body of insulating material around said intermediate portion for providing a mold shutoff.

2. An electrical conductor element for bushing assembly of the type described comprising an elongated cast metal conductor member including a portion around which a body of insulating material is to be molded, a free end portion for connection to complementary electrical means, and a connecting portion joining said first-mentioned portion and said free end portion and a preformed annular metal insert surrounding and secured to said joining portion and having an accurately dimensioned exterior surface cooperable with a mold during molding of a body of insulating material around said first-mentioned portion for providing a mold shutoff.

3. A method of producing an electrical bushing assembly having an electrical conductor element with a body of insulating material molded around one portion of the element and another portion of the element projecting outwardly of said body, said method comprising providing a preformed tubular metal insert having a relatively accurately dimensioned peripheral surface, placing said insert in a mold having a cavity for forming said conductor element, introducing molten metal into said mold cavity for filling the cavity and said tubular insert and thereby forming the cast electrical conductor with said insert fixed with respect thereto, thereafter placing said electrical conductor in a second mold having a cavity for forming the body of insulating material and a passageway from the cavity for accommodating the portion of the electrical conductor which projects from the insulating material body, said accurately dimensioned insert surface tightly engaging surface means of said second mold for sealing said passageway and thereby providing a mold shutoff, and thereafter pressure feeding insulating material to fill said second mold cavity.

* * * * *